US007750871B2

(12) United States Patent
Shoji et al.

(10) Patent No.: US 7,750,871 B2
(45) Date of Patent: Jul. 6, 2010

(54) IMAGE DISPLAY METHOD

(75) Inventors: Hidehiko Shoji, Osaka (JP); Takahiko Origuchi, Osaka (JP); Minoru Takeda, Osaka (JP); Akira Yawata, Osaka (JP); Hiroko Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 740 days.

(21) Appl. No.: 11/632,477

(22) PCT Filed: Aug. 4, 2006

(86) PCT No.: PCT/JP2006/315460

§ 371 (c)(1),
(2), (4) Date: Jan. 16, 2007

(87) PCT Pub. No.: WO2007/018135

PCT Pub. Date: Feb. 15, 2007

(65) Prior Publication Data

US 2008/0309591 A1 Dec. 18, 2008

(30) Foreign Application Priority Data

Aug. 5, 2005 (JP) ..... 2005-228189

(51) Int. Cl.
*G09G 3/28* (2006.01)

(52) U.S. Cl. ..... 345/60; 345/63

(58) Field of Classification Search ..... 345/36–39, 345/45–46, 50–53, 55, 60–68, 76–78, 82–84, 345/87–95, 99–100, 204, 208, 211, 214; 315/169.4
See application file for complete search history.

(56) References Cited

U.S. PATENT DOCUMENTS

2002/0054000 A1 5/2002 Tokunaga et al.
2004/0125051 A1 7/2004 Hirakawa et al.
2005/0162349 A1 7/2005 Kojima et al.
2005/0237277 A1 10/2005 Kawahara

FOREIGN PATENT DOCUMENTS

JP 9-305142 A 11/1997

(Continued)

*Primary Examiner*—Richard Hjerpe
*Assistant Examiner*—Mansour M Said
(74) *Attorney, Agent, or Firm*—McDermott Will & Emery LLP

(57) ABSTRACT

An image display method for allowing an image display device having a large number of pixels arrayed in a planar form to perform an image display by forming one field period from plural sub-fields for which luminance weights to be displayed are determined, and choosing plural luminances among displayable luminances as luminances for display by combining the luminance weights of the sub-fields, so that the respective pixels are controlled not to emit light or to emit light in each sub-field correspondingly to the luminances for display to be displayed. At least one threshold value is set, and when a pixel is allowed to emit light at a luminance for display at or higher than a first threshold value, which is the smallest threshold value, the pixel is controlled not to emit light constantly or to emit light constantly in a sub-field having the smallest luminance weight.

7 Claims, 11 Drawing Sheets

FOREIGN PATENT DOCUMENTS

| | | | |
|---|---|---|---|
| JP | 2000-231362 | A | 8/2000 |
| JP | 2001-34229 | A | 2/2001 |
| JP | 2002-23694 | A | 1/2002 |
| JP | 2003-271094 | A | 9/2003 |
| JP | 2004-29265 | A | 1/2004 |
| JP | 2004-212559 | A | 7/2004 |
| JP | 2005-202059 | A | 7/2005 |

FIG. 5A

| Luminance for display \ Sub-field | 1st SF | 2nd SF | 3rd SF | 4th SF | 5th SF | 6th SF | 7th SF | 8th SF | 9th SF | 10th SF |
|---|---|---|---|---|---|---|---|---|---|---|
| Luminance weight | 1 | 2 | 3 | 6 | 11 | 18 | 30 | 44 | 60 | 81 |
| 0 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 2 | 0 | 1 | 0 | 0 | 0 | 0 | 0 | 0 | 0 | 0 |
| | | | | | | | | | | |
| | | | | 1 | 1 | 1 | 0 | 1 | 0 | 0 |
| 86 | 1 | 1 | 1 | 1 | 0 | 0 | 1 | 1 | 0 | 0 |
| 88 | 1 | 1 | 0 | 0 | 1 | 0 | 1 | 1 | 0 | 0 |
| 89 | 1 | 0 | 1 | 0 | 1 | 0 | 1 | 1 | 0 | 0 |
| 91 | 1 | 1 | 1 | 0 | 1 | 0 | 1 | 1 | 0 | 0 |
| 93 | 0 | 1 | 0 | 1 | 1 | 0 | 1 | 1 | 0 | 0 |
| 95 | 1 | 0 | 1 | 1 | 1 | 0 | 1 | 1 | 0 | 0 |
| 97 | 1 | 1 | 1 | 1 | 1 | 0 | 1 | 1 | 0 | 0 |
| 99 | 1 | 0 | 0 | 1 | 0 | 1 | 1 | 1 | 0 | 0 |
| 101 | 1 | 1 | 0 | 1 | 0 | 1 | 1 | 1 | 0 | 0 |
| 104 | 1 | 1 | 1 | 1 | 0 | 1 | 1 | 1 | 0 | 0 |
| 106 | 1 | 1 | 0 | 0 | 1 | 1 | 1 | 1 | 0 | 0 |
| 107 | 1 | 0 | 1 | 0 | 1 | 1 | 1 | 1 | 0 | 0 |
| 109 | 1 | 1 | 1 | 0 | 1 | 1 | 1 | 1 | 0 | 0 |
| 112 | 1 | 1 | 0 | 1 | 1 | 1 | 1 | 1 | 0 | 0 |
| 113 | 1 | 0 | 1 | 1 | 1 | 1 | 1 | 1 | 0 | 0 |
| 115 | 1 | 1 | 1 | 1 | 1 | 1 | 1 | 1 | 0 | 0 |
| 118 | 1 | 0 | 1 | 1 | 0 | 1 | 1 | 0 | 1 | 0 |
| 120 | 1 | 1 | 1 | 1 | 0 | 1 | 1 | 0 | 1 | 0 |
| 123 | 1 | 0 | 1 | 0 | 1 | 1 | 1 | 0 | 1 | 0 |
| 125 | 1 | 1 | 1 | 0 | 1 | 1 | 1 | 0 | 1 | 0 |
| 128 | 1 | 1 | 0 | 1 | 1 | 1 | 1 | 0 | 1 | 0 |
| 131 | 1 | 1 | 1 | 1 | 1 | 1 | 1 | 0 | 1 | 0 |
| 134 | 1 | 1 | 1 | 1 | 0 | 1 | 0 | 1 | 1 | 0 |
| 136 | 1 | 1 | 0 | 0 | 1 | 1 | 0 | 1 | 1 | 0 |
| 139 | 1 | 1 | 1 | 0 | 1 | 1 | 0 | 1 | 1 | 0 |

FIG. 5B

| Luminance for display / Sub-field | 1st SF | 2nd SF | 3rd SF | 4th SF | 5th SF | 6th SF | 7th SF | 8th SF | 9th SF | 10th SF |
|---|---|---|---|---|---|---|---|---|---|---|
| Luminance weight | 1 | 2 | 3 | 6 | 11 | 18 | 30 | 44 | 60 | 81 |
| 142 | 1 | 1 | 0 | 1 | 1 | 1 | 0 | 1 | 1 | 0 |
| 145 | 1 | 1 | 1 | 1 | 1 | 1 | 0 | 1 | 1 | 0 |
| 146 | 1 | 1 | 1 | 1 | 0 | 0 | 1 | 1 | 1 | 0 |
| 149 | 1 | 0 | 1 | 0 | 1 | 0 | 1 | 1 | 1 | 0 |
| 152 | 1 | 0 | 0 | 1 | 1 | 0 | 1 | 1 | 1 | 0 |
| 155 | 1 | 0 | 1 | 1 | 1 | 0 | 1 | 1 | 1 | 0 |
| 159 | 1 | 0 | 0 | 1 | 0 | 1 | 1 | 1 | 1 | 0 |
| 162 | 1 | 0 | 1 | 1 | 0 | 1 | 1 | 1 | 1 | 0 |
| 166 | 1 | 1 | 0 | 0 | 1 | 1 | 1 | 1 | 1 | 0 |
| 169 | 1 | 1 | 1 | 0 | 1 | 1 | 1 | 1 | 1 | 0 |
| 172 | 1 | 1 | 0 | 1 | 1 | 1 | 1 | 1 | 1 | 0 |
| 175 | 1 | 1 | 1 | 1 | 1 | 1 | 1 | 1 | 1 | 0 |
| 179 | 1 | 1 | 1 | 0 | 0 | 1 | 1 | 1 | 0 | 1 |
| 182 | 1 | 1 | 0 | 1 | 0 | 1 | 1 | 1 | 0 | 1 |
| 187 | 1 | 1 | 0 | 0 | 1 | 1 | 1 | 1 | 0 | 1 |
| 190 | 1 | 1 | 1 | 0 | 1 | 1 | 1 | 1 | 0 | 1 |
| 193 | 1 | 1 | 0 | 1 | 1 | 1 | 1 | 1 | 0 | 1 |
| 198 | 1 | 1 | 0 | 1 | 0 | 1 | 1 | 0 | 1 | 1 |
| 201 | 1 | 1 | 1 | 1 | 0 | 1 | 1 | 0 | 1 | 1 |
| 206 | 1 | 1 | 1 | 0 | 1 | 1 | 1 | 0 | 1 | 1 |
| 209 | 1 | 1 | 0 | 1 | 1 | 1 | 1 | 0 | 1 | 1 |
| 215 | 1 | 1 | 1 | 1 | 0 | 1 | 0 | 1 | 1 | 1 |
| 220 | 1 | 1 | 1 | 0 | 1 | 1 | 0 | 1 | 1 | 1 |
| 223 | 1 | 1 | 0 | 1 | 1 | 1 | 0 | 1 | 1 | 1 |
| 226 | 1 | 1 | 1 | 1 | 1 | 1 | 0 | 1 | 1 | 1 |
| 232 | 1 | 1 | 1 | 0 | 1 | 0 | 1 | 1 | 1 | 1 |
| 238 | 1 | 1 | 1 | 1 | 1 | 0 | 1 | 1 | 1 | 1 |
| 242 | 1 | 1 | 0 | 1 | 0 | 1 | 1 | 1 | 1 | 1 |
| 245 | 1 | 1 | 1 | 1 | 0 | 1 | 1 | 1 | 1 | 1 |
| 250 | 1 | 1 | 1 | 0 | 1 | 1 | 1 | 1 | 1 | 1 |
| 256 | 1 | 1 | 1 | 1 | 1 | 1 | 1 | 1 | 1 | 1 |

FIG. 8A

Interval of luminances

Interval of luminances

| Gray-scale | Display luminance | | Gray-scale | Display luminance | | Gray-scale | Display luminance | |
|---|---|---|---|---|---|---|---|---|
| 0 | 0.0 | 1.0 | 28 | 28.0 | 1.0 | 56 | 56.6 | 1.1 |
| 1 | 1.0 | 1.0 | 29 | 29.0 | 1.0 | 57 | 57.7 | 1.2 |
| 2 | 2.0 | 1.0 | 30 | 30.0 | 1.0 | 58 | 58.9 | 1.2 |
| 3 | 3.0 | 1.0 | 31 | 31.0 | 1.0 | 59 | 60.1 | 1.2 |
| 4 | 4.0 | 1.0 | 32 | 32.0 | 1.0 | 60 | 61.3 | 1.2 |
| 5 | 5.0 | 1.0 | 33 | 33.0 | 1.0 | 61 | 62.5 | 1.3 |
| 6 | 6.0 | 1.0 | 34 | 34.0 | 1.0 | 62 | 63.8 | 1.3 |
| 7 | 7.0 | 1.0 | 35 | 35.0 | 1.0 | 63 | 65.0 | 1.3 |
| 8 | 8.0 | 1.0 | 36 | 36.0 | 1.0 | 64 | 66.3 | 1.3 |
| 9 | 9.0 | 1.0 | 37 | 37.0 | 1.0 | 65 | 67.7 | 1.4 |
| 10 | 10.0 | 1.0 | 38 | 38.0 | 1.0 | 66 | 69.0 | 1.4 |
| 11 | 11.0 | 1.0 | 39 | 39.0 | 1.0 | 67 | 70.4 | 1.4 |
| 12 | 12.0 | 1.0 | 40 | 40.0 | 1.0 | 68 | 71.8 | 1.4 |
| 13 | 13.0 | 1.0 | 41 | 41.0 | 1.0 | 69 | 73.2 | 1.5 |
| 14 | 14.0 | 1.0 | 42 | 42.0 | 1.0 | 70 | 74.7 | 1.5 |
| 15 | 15.0 | 1.0 | 43 | 43.0 | 1.0 | 71 | 76.2 | 1.5 |
| 16 | 16.0 | 1.0 | 44 | 44.0 | 1.0 | 72 | 77.7 | 1.6 |
| 17 | 17.0 | 1.0 | 45 | 45.0 | 1.0 | 73 | 79.3 | 1.6 |
| 18 | 18.0 | 1.0 | 46 | 46.0 | 1.0 | 74 | 80.9 | 1.6 |
| 19 | 19.0 | 1.0 | 47 | 47.0 | 1.0 | 75 | 82.5 | 1.6 |
| 20 | 20.0 | 1.0 | 48 | 48.0 | 1.0 | 76 | 84.1 | 1.7 |
| 21 | 21.0 | 1.0 | 49 | 49.0 | 1.0 | 77 | 85.8 | 1.7 |
| 22 | 22.0 | 1.0 | 50 | 50.0 | 1.3 | 78 | 87.5 | 1.8 |
| 23 | 23.0 | 1.0 | 51 | 51.3 | 1.0 | 79 | 89.3 | 1.8 |
| 24 | 24.0 | 1.0 | 52 | 52.3 | 1.0 | 80 | 91.1 | 1.8 |
| 25 | 25.0 | 1.0 | 53 | 53.3 | 1.1 | 81 | 92.9 | 1.9 |
| 26 | 26.0 | 1.0 | 54 | 54.4 | 1.1 | 82 | 94.7 | 1.9 |
| 27 | 27.0 | 1.0 | 55 | 55.5 | 1.1 | 83 | 96.6 | 1.9 |

FIG. 8B

| Grayscale | Display luminance | Interval of luminances |
|---|---|---|
| 84 | 98.6 | 2.0 |
| 85 | 100.5 | 2.0 |
| 86 | 102.5 | 2.1 |
| 87 | 104.6 | 2.1 |
| 88 | 106.7 | 2.1 |
| 89 | 108.8 | 2.2 |
| 90 | 111.0 | 2.2 |
| 91 | 113.2 | 2.3 |
| 92 | 115.5 | 2.3 |
| 93 | 117.8 | 2.4 |
| 94 | 120.2 | 2.4 |
| 95 | 122.6 | 2.5 |
| 96 | 125.0 | 2.5 |
| 97 | 127.5 | 2.6 |
| 98 | 130.1 | 2.6 |
| 99 | 132.7 | 2.7 |
| 100 | 135.3 | 2.7 |
| 101 | 138.0 | 2.8 |
| 102 | 140.8 | 2.8 |
| 103 | 143.6 | 2.9 |
| 104 | 146.5 | 2.9 |
| 105 | 149.4 | 3.0 |
| 106 | 152.4 | 3.0 |
| 107 | 155.4 | 3.1 |
| 108 | 158.5 | 3.2 |
| 109 | 161.7 | 3.2 |
| 110 | 164.9 | 3.3 |
| 111 | 168.2 | 3.4 |

| Grayscale | Display luminance | Interval of luminances |
|---|---|---|
| 112 | 171.6 | 3.4 |
| 113 | 175.0 | 3.5 |
| 114 | 178.5 | 3.6 |
| 115 | 182.1 | 3.6 |
| 116 | 185.8 | 3.7 |
| 117 | 189.5 | 3.8 |
| 118 | 193.3 | 3.9 |
| 119 | 197.1 | 3.9 |
| 120 | 201.1 | 4.0 |
| 121 | 205.1 | 4.1 |
| 122 | 209.2 | 4.2 |
| 123 | 213.4 | 4.3 |
| 124 | 217.6 | 4.4 |
| 125 | 222.0 | 4.4 |
| 126 | 226.4 | 4.5 |
| 127 | 231.0 | 4.6 |
| 128 | 235.6 | 4.7 |
| 129 | 240.3 | 4.8 |
| 130 | 245.1 | 4.9 |
| 131 | 250.0 | 5.0 |
| 132 | 255.0 | |

Luminances for display

FIG. 9A

| Sub-field / Luminance weight | 1st SF | 2nd SF | 3rd SF | 4th SF | 5th SF | 6th SF | 7th SF | 8th SF | 9th SF | 10th SF |
|---|---|---|---|---|---|---|---|---|---|---|
| | 1 | 2 | 3 | 6 | 11 | 18 | 30 | 44 | 60 | 81 |
| 0 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 2 | 0 | 1 | 0 | 0 | 0 | 0 | 0 | 0 | 0 | 0 |
| | | | | | | | | | | |
| | | | | | 1 | 0 | 0 | 0 | 0 | 0 |
| 22 | 0 | 1 | 1 | 1 | 1 | 0 | 0 | 0 | 0 | 0 |
| 23 | 1 | 1 | 1 | 1 | 1 | 0 | 0 | 0 | 0 | 0 |
| 24 | 1 | 1 | 1 | 0 | 0 | 1 | 0 | 0 | 0 | 0 |
| 25 | 1 | 0 | 0 | 1 | 0 | 1 | 0 | 0 | 0 | 0 |
| 27 | 1 | 1 | 0 | 1 | 0 | 1 | 0 | 0 | 0 | 0 |
| 28 | 1 | 0 | 1 | 1 | 0 | 1 | 0 | 0 | 0 | 0 |
| 30 | 1 | 1 | 1 | 1 | 0 | 1 | 0 | 0 | 0 | 0 |
| 32 | 1 | 1 | 0 | 0 | 1 | 1 | 0 | 0 | 0 | 0 |
| 33 | 1 | 0 | 1 | 0 | 1 | 1 | 0 | 0 | 0 | 0 |
| 35 | 1 | 1 | 1 | 0 | 1 | 1 | 0 | 0 | 0 | 0 |
| 36 | 1 | 0 | 0 | 1 | 1 | 1 | 0 | 0 | 0 | 0 |
| 38 | 1 | 1 | 0 | 1 | 1 | 1 | 0 | 0 | 0 | 0 |
| 39 | 1 | 0 | 1 | 1 | 1 | 1 | 0 | 0 | 0 | 0 |
| 41 | 1 | 1 | 1 | 1 | 1 | 1 | 0 | 0 | 0 | 0 |
| 42 | 1 | 1 | 1 | 1 | 0 | 0 | 1 | 0 | 0 | 0 |
| 44 | 1 | 1 | 0 | 0 | 1 | 0 | 1 | 0 | 0 | 0 |
| 47 | 1 | 1 | 1 | 0 | 1 | 0 | 1 | 0 | 0 | 0 |
| 50 | 1 | 1 | | | | | | | | |
| | | | | | | | | | | |
| 109 | 1 | 1 | 1 | 0 | 1 | 1 | 1 | 1 | 0 | 0 |
| 112 | 1 | 1 | 0 | 1 | 1 | 1 | 1 | 1 | 0 | 0 |
| 115 | 1 | 1 | 1 | 1 | 1 | 1 | 1 | 1 | 0 | 0 |
| 120 | 1 | 1 | 1 | 1 | 0 | 1 | 1 | 0 | 1 | 0 |
| 125 | 1 | 1 | 1 | 0 | 1 | 1 | 1 | 0 | 1 | 0 |
| 131 | 1 | 1 | 1 | 1 | 1 | 1 | 1 | 0 | 1 | 0 |
| 134 | 1 | 1 | 1 | 1 | 0 | 1 | 0 | 1 | 1 | 0 |

FIG. 9B

Luminances for display

| Sub-field | 1st SF | 2nd SF | 3rd SF | 4th SF | 5th SF | 6th SF | 7th SF | 8th SF | 9th SF | 10th SF |
|---|---|---|---|---|---|---|---|---|---|---|
| Luminance weight | 1 | 2 | 3 | 6 | 11 | 18 | 30 | 44 | 60 | 81 |
| 139 | 1 | 1 | 1 | 0 | 1 | 1 | 0 | 1 | 1 | 0 |
| 145 | 1 | 1 | 1 | 1 | 1 | 1 | 0 | 1 | 1 | 0 |
| 146 | 1 | 1 | 1 | 1 | 0 | 0 | 1 | 1 | 1 | 0 |
| 151 | 1 | 1 | 1 | 0 | 1 | 0 | 1 | 1 | 1 | 0 |
| 157 | 1 | 1 | 1 | 1 | 1 | 0 | 1 | 1 | 1 | 0 |
| 158 | 1 | 1 | 1 | 0 | 0 | 1 | 1 | 1 | 1 | 0 |
| 164 | 1 | 1 | 1 | 1 | 0 | 1 | 1 | 1 | 1 | 0 |
| 169 | 1 | 1 | 1 | 0 | 1 | 1 | 1 | 1 | 1 | 0 |
| 175 | 1 | 1 | 1 | 1 | 1 | 1 | 1 | 1 | 1 | 0 |
| 178 | 1 | 1 | 1 | 1 | 1 | 0 | 1 | 1 | 0 | 1 |
| 185 | 1 | 1 | 1 | 1 | 0 | 1 | 1 | 1 | 0 | 1 |
| 196 | 1 | 1 | 1 | 1 | 1 | 1 | 1 | 1 | 0 | 1 |
| 201 | 1 | 1 | 1 | 1 | 0 | 1 | 1 | 0 | 1 | 1 |
| 212 | 1 | 1 | 1 | 1 | 1 | 1 | 1 | 0 | 1 | 1 |
| 215 | 1 | 1 | 1 | 1 | 0 | 1 | 0 | 1 | 1 | 1 |
| 226 | 1 | 1 | 1 | 1 | 1 | 1 | 0 | 1 | 1 | 1 |
| 227 | 1 | 1 | 1 | 1 | 0 | 0 | 1 | 1 | 1 | 1 |
| 238 | 1 | 1 | 1 | 1 | 1 | 0 | 1 | 1 | 1 | 1 |
| 245 | 1 | 1 | 1 | 1 | 0 | 1 | 1 | 1 | 1 | 1 |
| 256 | 1 | 1 | 1 | 1 | 1 | 1 | 1 | 1 | 1 | 1 |

IMAGE DISPLAY METHOD

RELATED APPLICATIONS

This application is the U.S. National Phase under 35 U.S.C. §371 of International Application No. PCT/JP2006/315490, filed on Aug. 4, 2006, which in turn claims the benefit of Japanese Application No. 2005-228189, filed on Aug. 5, 2005, the disclosures of which Applications are incorporated by reference herein.

TECHNICAL FIELD

The present invention relates to an image display method for an image display apparatus, such as a plasma display panel.

BACKGROUND ART

A plasma display panel (hereinafter, referred to simply as the panel) as a representative of an image display device having a large number of pixels arrayed in a planar form is provided with a large number of discharge cells serving as pixels in a space between a front plate and a rear plate disposed oppositely. Regarding the front plate, plural pairs of scanning electrodes and sustaining electrodes, each pair forming a display electrode, are formed on the front glass substrate to be parallel to each other, and a dielectric layer and a protection layer are formed to cover these display electrodes. Regarding the rear plate, plural data electrodes are formed on the rear glass substrate in parallel with each other, and a dielectric layer is formed to cover these data electrodes, plus plural partition walls are formed on the dielectric layer in parallel with the data electrodes. A phosphor layer is formed on the surface of the dielectric layer and the side surfaces of the partition walls. The front plate and the rear plate are encapsulated while being disposed oppositely in such a manner that the display electrodes and the data electrodes spatially intersect with each other, and a discharge gas is sealed in a discharge space in the interior thereof. A discharge cell is formed in a portion where the display electrode and the data electrode oppose each other. A color display is enabled on the panel of the configuration as described above by generating UV rays through a gas discharge within each discharge cell to give rise to excited luminescence in fluorescent materials of the respective colors in the RGB representation with the UV rays.

The sub-field method is used as a method of driving the panel. This is a method of performing luminance display by dividing one field period into plural sub-fields and by controlling each discharge cell to emit light or not to emit light in each sub-field. Each sub-field has an initialization period, a writing period, and a sustaining period. In the initialization period, the discharge cell performs an initialization discharge to form a wall electric charge needed for the following writing operation. In the writing period, a scanning pulse is applied successively to the scanning electrodes and a writing pulse corresponding to an image signal to be displayed is applied to the data electrodes at the same time for selectively giving rise to a writing discharge between the scanning electrode and the data electrode, thereby forming a wall electric charge selectively. In the following sustaining period, a sustaining pulse is applied between the scanning electrode and the sustaining electrode a specific number of times corresponding to the display luminance at which light is to be emitted for selectively giving rise to a discharge in the discharge cell having formed the wall electric charge by the writing discharge to emit light. A ratio of the display luminances for each sub-field is referred to as luminance weight.

As means for driving the panel, a scanning electrode driving circuit to drive the scanning electrodes, a sustaining electrode driving circuit to drive the sustaining electrodes, and a data electrode driving circuit to drive the data electrodes are provided, and the respective electrode driving circuits apply necessary driving waveforms to the corresponding electrodes. Among these electrode driving circuits, because the data electrode driving circuit needs to form a driving waveform independently for each data electrode according to an image signal, it is normally formed using an IC for exclusive use. Meanwhile, when viewed from the data electrode driving circuit side, each data electrode is a capacitive load having a combined capacity with the adjacent data electrode, the scanning electrode, and the sustaining electrode. It is therefore necessary to charge and discharge this capacity in order to apply a driving waveform to the respective data electrodes. It is, however, necessary to reduce power consumption of the data electrode driving circuit as much as possible in order to realize the driving circuit in the form of an IC. In addition, the proportion of power consumption of the data electrode driving circuit in total power consumption of the plasma display apparatus is by no means small. Hence, in terms of reducing power consumption of the plasma display apparatus, there has been a need to reduce power consumption of the data electrode driving circuit.

Power consumption of the data electrode driving circuit increases as a charge and discharge current for the capacity of the data electrode increases, and the charge and discharge current largely depends on an image signal to be displayed. For example, because the charge and discharge current is 0 when the writing pulse is applied to none of the data electrodes, power consumption becomes a minimum. Likewise, because the charge and discharge current is also 0 when the writing pulse is applied to all the data electrodes, power consumption is small. However, when the writing pulse is applied to the data electrodes at random, the charge and discharge current becomes larger, and in particular, when the writing pulse is applied alternately to the adjacent data electrodes, an electrostatic capacity between the adjacent data electrodes and an electrostatic capacity between the scanning electrode and the sustaining electrode are charged and discharged, which makes power consumption extremely large.

Given these circumstances, as a method of reducing power consumption of the data electrode circuit, for example, a method of detecting an image signal that consumes large power and replacing this image signal with an image signal consuming less power is disclosed in Japanese Patent Unexamined Publication No. 2002-23694. Also, a method of detecting power consumption of the data electrode driving circuit and limiting the levels of grayscale to be displayed when power consumption becomes large is disclosed in Japanese Patent Unexamined Publication No. 2003-271094.

When these methods are implemented, however, the size of the signal processing circuit becomes larger. Hence, there are problems that not only the circuit costs are increased, but also the resolution of luminance display becomes insufficient under some circumstances by displaying an image different from the original image that should be displayed or by limiting the levels of grayscale to be displayed.

DISCLOSURE OF THE INVENTION

An image display method of the invention allows an image display device having a large number of pixels arrayed in a planar form to perform an image display by forming one field period from plural sub-fields for which luminance weights to be displayed are determined, and choosing plural luminances among displayable luminances as luminances for display by combining the luminance weights of the sub-fields, so that the respective pixels are controlled to emit light or not to emit light in each sub-field correspondingly to the luminances for display to be displayed. At least one threshold value to be compared with the luminances for display is set, and when a pixel is allowed to emit light at a luminance for display at or higher than a first threshold value, which is a smallest threshold value among threshold values, the pixel is controlled not to emit light constantly or to emit light constantly in a sub-field having a smallest luminance weight.

According to the image display method as described above, it is possible to provide a method of reducing power consumption of the data electrode driving circuit without impairing the image display quality.

BRIEF DESCRIPTION OF THE DRAWINGS

FIG. 5A is a view showing luminances for display, 0 to 139, and the coding thereof in the image display method according to the embodiment of the invention.

FIG. 5B is a view showing luminances for display, 142 to 256, and the coding thereof in the image display method according to the embodiment of the invention.

FIG. 8A is a view showing display luminances 0 to 83 formed in the image display method according to the embodiment of the invention.

FIG. 8B is a view showing display luminances 84 to 132 formed in the image display method according to the embodiment of the invention.

FIG. 9A is a view showing luminances for display, 0 to 134, and the coding thereof used for display in the image display method according to another embodiment of the invention.

FIG. 9B is a view showing luminances for display, 139 to 256, and the coding thereof used for display in the image display method according to the another embodiment of the invention.

DESCRIPTION OF REFERENCE NUMERALS AND SIGNS

Figure 1:
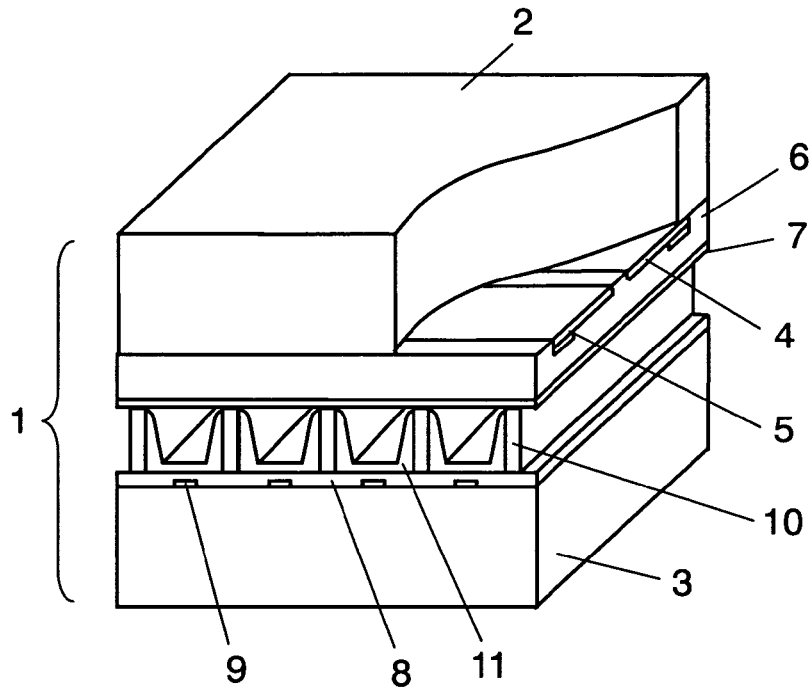
FIG. 1 is a perspective view showing a major portion of a panel used in an image display method according to one embodiment of the invention.

1 plasma display panel
2 front substrate
3 rear substrate
4 scanning electrode
5 sustaining electrode
9 data electrode
12 data electrode driving circuit
13 scanning electrode driving circuit
14 sustaining electrode driving circuit
15 timing generation circuit
18 image signal processing circuit

PREFERRED EMBODIMENTS FOR CARRYING OUT THE INVENTION

Hereinafter, image display methods according to embodiments of the invention will be described with reference to the drawings.

Embodiment

FIG. 1 is a perspective view showing a major portion of a panel used in one embodiment of the invention. Panel 1 is formed by oppositely disposing front substrate 2 and rear substrate 3 made of glass to define a discharge space therebetween. On front substrate 2, plural scanning electrodes 4 and plural sustaining electrodes 5 forming display electrodes are formed in pairs to be parallel to each other. Dielectric layer 6 is formed to cover scanning electrodes 4 and sustaining electrodes 5, and protection layer 7 is formed on dielectric layer 6. Plural data electrodes 9 covered with insulation layer 8 are provided on rear substrate 3, and partition walls 10 are provided on insulation layer 8 in parallel with data electrodes 9. Phosphor layer 11 is formed on the surface of insulation layer 8 and the side surfaces of partition walls 10. Front substrate 2 and rear substrate 3 are disposed oppositely in a direction for scanning electrodes 4 and sustaining electrodes 5 to intersect with data electrodes 9. As a discharge gas, for example, a mixed gas of neon and xenon is sealed in a discharge space defined therebetween. The structure of the panel is not limited to the structure described above, and for example, the panel may be provided with lattice partition walls.

Figure 2:
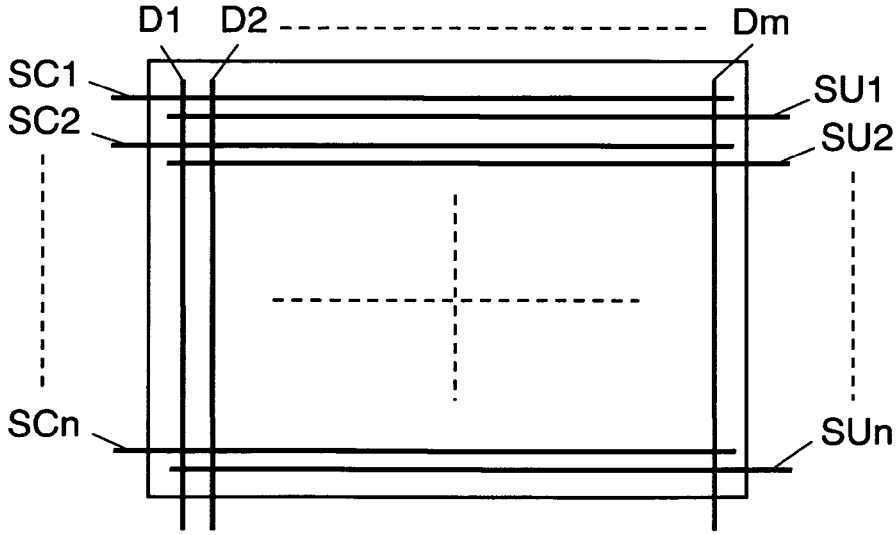
FIG. 2 is a view showing arrays of electrodes in the panel using the image display method according to the embodiment of the invention.

FIG. 2 is a view showing arrays of electrodes in the panel used in this embodiment of the invention. Herein, n scanning electrodes SC1 through SCn (scanning electrodes 4 in FIG. 1) and n sustaining electrodes SU1 through SUn (sustaining electrodes 5 in FIG. 1) are arrayed in the row direction, while m data electrodes D1 through Dm (data electrodes 9 in FIG. 1) are arrayed in the column direction. A discharge cell is formed in a portion where a pair of scanning electrode SCi and sustaining electrode SUi (i=1 to n) and one data electrode Dj (j=1 to m) intersect with each other, thereby forming m×n discharge cells within the discharge space.

Figure 3:
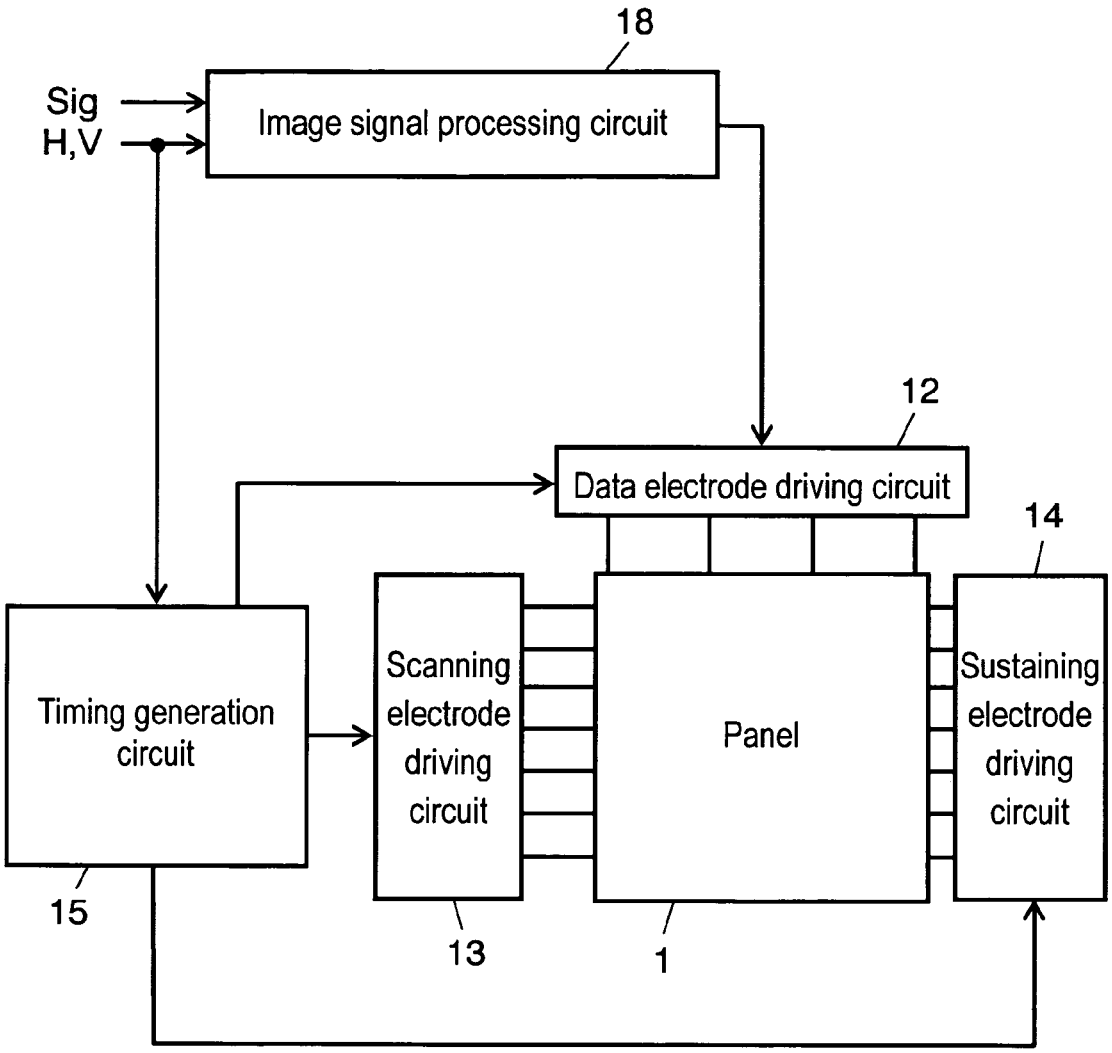
FIG. 3 is a circuit block diagram of a plasma display apparatus using the image display method according to the embodiment of the invention.

FIG. 3 is a circuit block diagram of a plasma display apparatus using the image display method of the panel used in this embodiment of the invention. The plasma display apparatus includes panel 1, data electrode driving circuit 12, scanning electrode driving circuit 13, sustaining electrode driving circuit 14, timing generation circuit 15, image signal processing circuit 18, and a power supply circuit (not shown). Image signal processing circuit 18 converts image signal sig to image data corresponding to the number of pixels in panel 1, and divides the image data for each pixel into plural bits corresponding to plural sub-fields and outputs the resulting image data to data electrode driving circuit 12. Data electrode driving circuit 12 converts the image data for each sub-field to signals corresponding to respective data electrodes D1 through Dm to drive respective electrodes D1 through Dm. Timing generation circuit 15 generates a timing signal on the basis of horizontal synchronization signal H and vertical synchronization signal V, and supplies the timing signal to the respective driving circuit blocks. Scanning electrode driving circuit 13 supplies scanning electrodes SC1 through SCn with driving waveforms according to the timing signal, and sustaining electrode driving circuit 14 supplies sustaining electrodes SU1 through SUn with driving waveforms according to the timing signal.

Among these driving circuits, because the data electrode driving circuit needs to generate a driving waveform independently for each data electrode according to an image signal, it is formed using an IC for exclusive use, which makes it impossible to increase power consumption considerably.

Driving voltage waveforms to drive the panel and the operations thereof will now be described. In this embodiment, descriptions will be given on the assumption that one field is divided into ten sub-fields (first SF, second SF . . . and tenth SF), and that the respective sub-fields have their own luminance weights ($W_1$=1, $W_2$=2, $W_3$=3, $W_4$=6, $W_5$=11, $W_6$=18, $W_7$=30, $W_8$=44, $W_9$=60, and $W_{10}$=81). It is set in this embodiment in such a manner that the luminance weights of the sub-fields disposed in latter positions become larger as specified above. It should be noted, however, that the number of the sub-fields and the luminance weights of the respective sub-fields are not limited to the values specified above.

Figure 4:
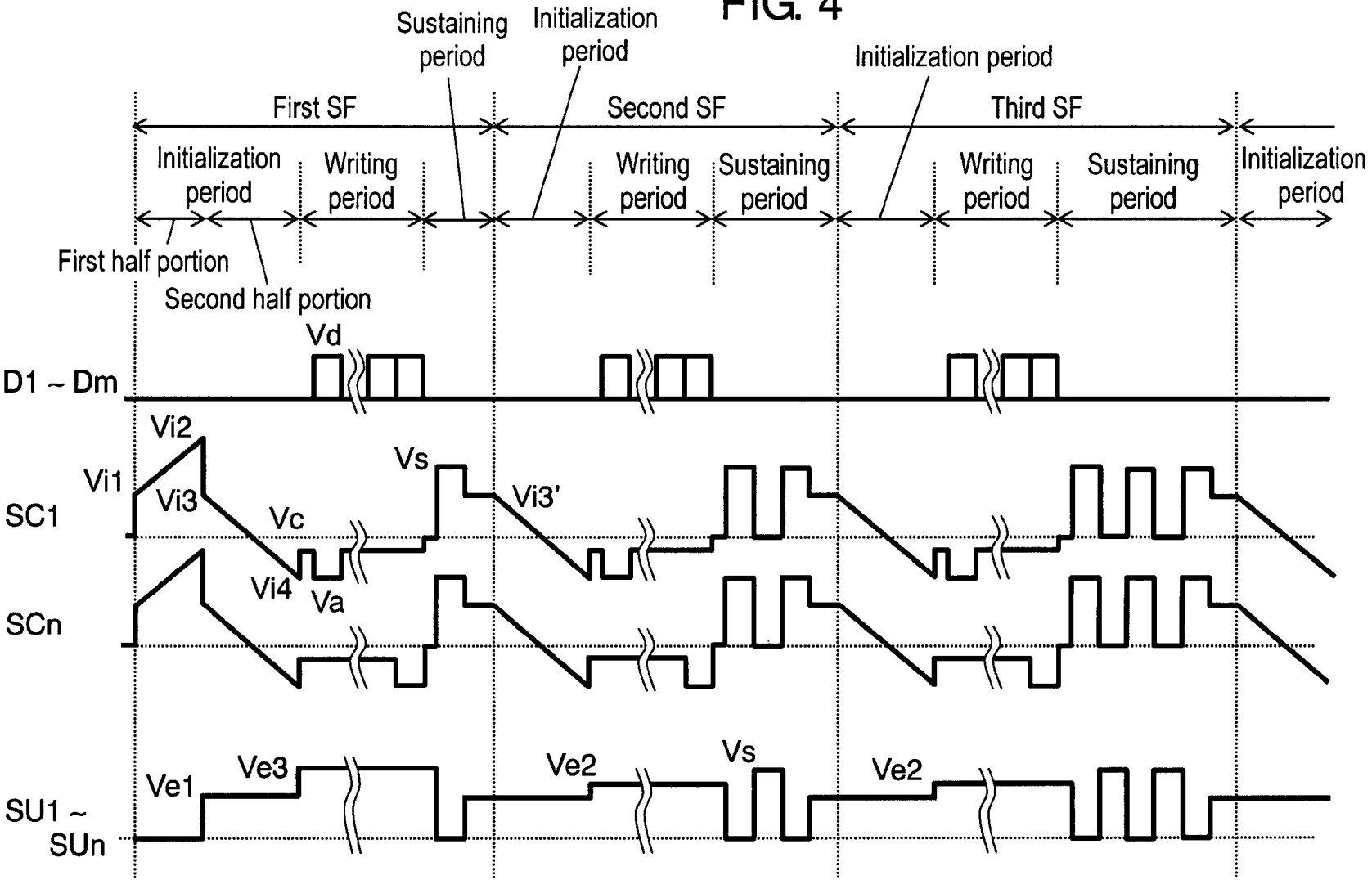
FIG. 4 is a view showing driving voltage waveforms applied to respective electrodes in the panel using the image display method according to the embodiment of the invention.

FIG. 4 is a view showing driving voltage waveforms applied to the respective electrodes in the panel used in this embodiment of the invention.

In the initialization period, a ramp voltage that rises gradually from voltage Vi1, which is equal to or lower than the discharge starting voltage, to voltage Vi2, which exceeds the discharge starting voltage, is applied to scanning electrodes SC1 through SCn while data electrodes D1 through Dm and sustaining electrodes SU1 through SUn are maintained at 0 V in the first half portion. Accordingly, a faint initialization discharge occurs in all the discharge cells, and wall voltages are accumulated on scanning electrodes SC1 through SCn, sustaining electrodes SU1 through SUn, and data electrodes D1 through Dm. The wall voltages on the electrodes referred to herein mean a voltage induced by a wall electric charge accumulated on the dielectric layer, the phosphor layer, and so forth covering the electrodes.

Subsequently, in the second half portion of the initialization period, a ramp voltage that decreases gradually from voltage Vi3 to voltage Vi4 is applied to scanning electrodes SC1 through SCn while sustaining electrodes SU1 through SUn are maintained at positive voltage Ve1. Accordingly, a faint initialization discharge occurs again in all the discharge cells, and the wall voltages on scanning electrodes SC1 through SCn, sustaining electrodes SU1 through SUn, and data electrodes D1 through Dm are adjusted to a value appropriate for a writing operation.

The first half portion in the initialization period may be omitted for some sub-fields among the sub-fields forming one field. In such a case, the initialization operation is selectively performed for a discharge cell that has performed a sustaining discharge in the immediately preceding sub-field. FIG. 4 shows driving waveforms for performing an initialization operation having the first half portion and the second half portion in the initialization period for first SF, and an initialization operation having the second half portion alone in the initialization periods for second SF and following sub-fields.

In the writing period, of data electrodes D1 through Dm, positive writing voltage Vd is applied to data electrode Dk (k=1 to m) in the discharge cell that should emit light in the first row, while negative scanning pulse voltage Va is applied to scanning electrode SC1 in the first row. Accordingly, a writing discharge occurs between data electrode Dk and scanning electrode SC1 and between sustaining electrode SU1 and scanning electrode SC1. A positive wall voltage is thus accumulated on scanning electrode SC1 and a negative wall voltage is accumulated on sustaining electrode SU1 in this discharge cell. A writing operation to accumulate the wall voltages on the respective electrodes by giving rise to a writing discharge in the discharge cell that should emit light in the first row is performed in this manner. On the other hand, a writing discharge does not occur at the intersection portion of data electrode Dh (h≠k) to which writing voltage Vd has not been applied and scanning electrode SC1. The writing operation as described above is performed successively, and the writing period ends when the writing operation has been performed on the discharge cells in the nth row.

It is data electrode driving circuit 12 that drives respective data electrodes D1 through Dm as described above. However, when viewed from data electrode driving circuit 12, each data electrode Dj is a capacitive load. It is therefore necessary to charge and discharge this capacity during the writing period each time a voltage to be applied to the respective data electrodes is switched to writing pulse voltage Vd from the ground potential, 0 V, or to the ground potential, 0 V, from writing pulse voltage Vd. When the number of charge and discharge operations is large, so is power consumption of data electrode driving circuit 12.

In the following sustaining period, sustaining electrodes SU1 through SUn are returned to 0 V, and sustaining pulse voltage Vs is applied to scanning electrodes SC1 through SCn. In the discharge cell in which the writing discharge has occurred in this instance, a voltage between scanning electrode SCi and sustaining electrode SUi is a sum obtained by adding the magnitude of the wall voltages on scanning electrode SCi and on sustaining electrode SUi to sustaining pulse voltage Vs, and exceeds the discharge starting voltage. A sustaining discharge thus occurs between scanning electrode SCi and sustaining electrode SUi and light is emitted. In this instance, a negative wall voltage is accumulated on scanning electrode SCi and a positive voltage is accumulated on sustaining electrode SUi. Subsequently, scanning electrodes SC1 through SCn are returned to 0 V, and sustaining pulse voltage Vs is applied to sustaining electrodes SU1 through SUn. Accordingly, in the discharge cell in which the sustaining discharge has occurred, a voltage between sustaining electrode SUi and scanning electrode SCi exceeds the discharge starting voltage. A sustaining discharge therefore occurs again between sustaining electrode SUi and scanning electrode SCi. Hence, a negative wall voltage is accumulated on sustaining electrode SUi and a positive wall voltage is accumulated on scanning electrode SCi. Thereafter, by applying sustaining pulses in the number proportional to the luminance weights to scanning electrodes SC1 through SCn and sustaining electrodes SU1 through SUn in the same manner as above, the sustaining discharge occurs continuously in the discharge cell in which the writing discharge has occurred during the writing period. In the discharge cell in which no writing discharge has occurred during the writing period, a sustaining discharge does not occur. The wall voltage when the initialization period ended is therefore maintained. The sustaining operation in the sustaining period ends in this manner.

The initialization period and the writing period in following second SF through tenth SF are the same as those in first SF, and a sustaining operation same as the sustaining operation during the sustaining period of first SF except for the number of sustaining pulses is performed during the sustaining period. The respective discharge cells are controlled to emit light or not to emit light in each sub-field in this manner, and an image display is performed by combining the luminance weights of the respective sub-fields. In this embodiment, however, an image display is not performed with the use of all the displayable luminances by combining the luminance weights of the sub-fields, but an image display is performed by choosing plural luminances as luminances for display among the displayable luminances and controlling the respective discharge cells to emit light or not to emit light for each sub-field correspondingly to the luminances for display to be displayed.

A relation (hereinafter, referred to as coding) indicating in which sub-field the discharge cell is allowed to emit light to display a given luminance will now be described. In order to make the description simpler, let "0" be the luminance at which black is displayed and "W" be the luminance corresponding to the luminance weight "W". Then, "1" is the luminance of the discharge cell that emits light only in first SF having the luminance weight 1, and "3" is the luminance of the discharge cell that emits light in first SF having the luminance weight 1 and in second SF having the luminance weight 2.

FIGS. 5A and 5B are views showing the luminances for display and the coding thereof in the image display method in this embodiment of the invention. Herein, the numerical values set forth in the leftmost column indicate the values of luminances for display, and the columns to the right thereof indicate whether the discharge cell is allowed to emit light in the respective sub-fields when the specified luminance is displayed. Herein, "0" indicates non-emission of light and "1" indicates emission of light. For example, in order to display the luminance "2", the discharge cell is allowed to emit light in second SF alone, and in order to display the luminance "84", the discharge cell is allowed to emit light in second SF through sixth SF and eighth SF. In a case where the luminance "3" is displayed, there are a method of allowing the discharge cell to emit light in both first SF and second SF, and a method of allowing the discharge cell to emit light in third SF alone. In such a case where more than one coding is possible, the coding that enables lighting in the sub-field having the luminance weight as small as possible is chosen. To be more specific, in the case of displaying the luminance "3", the discharge cell is allowed to emit light in both first SF and second SF.

The coding in this embodiment is characterized in that the discharge cells that display luminances at or higher than "100", which is a first threshold value, are controlled to emit light in first SF unfailingly, and the discharge cells that display luminances at or higher than "200", which is a second threshold value, are controlled to emit light in both first SF and second SF unfailingly. By executing the control in this manner, a voltage applied to the data electrodes corresponding to the discharge cells that display the luminances at or higher than "100" during the writing period of first SF is fixed to voltage Vd. It is thus possible to reduce a charge and discharge current of the data electrodes, which can in turn reduce power consumption of data electrode driving circuit 12. Also, in the discharge cells that display luminances at or higher than "200" during the writing period in first SF, a voltage applied to the data electrodes during the writing periods in first SF and second SF is fixed to voltage Vd. It is therefore possible to further reduce power consumption of data electrode driving circuit 12.

In addition, according to the coding in this embodiment, the luminances "55", "62" . . . "254", "255", and so forth are not included in the luminances for display, and these luminances are not used for display. However, even when an image display is performed using such coding, the display quality of an image will not be impaired markedly for the reason as follows.

The plasma display apparatus is originally configured to display an image by allowing the discharge cells to emit light a given number of times proportional to the luminance weights of the respective sub-fields and by allowing the respective discharge cells to emit light by controlling the sub-field in which light is to be emitted. Hence, the displayable luminances by the plasma display apparatus are not continuous and take additive values at intervals. The displayable luminances therefore form an arithmetic progression, such as "0", "1", "2" . . . and "255".

Figure 6A:
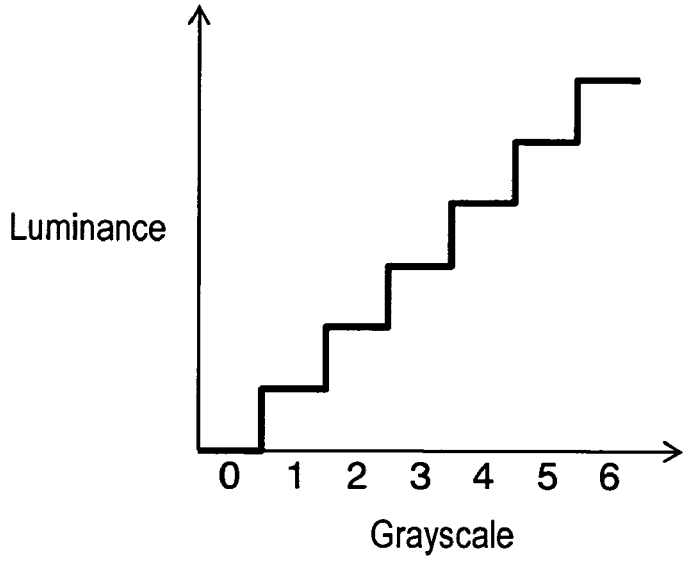
FIG. 6A is a view schematically showing a relation of the grayscale and displayable luminances.
Figure 6B:
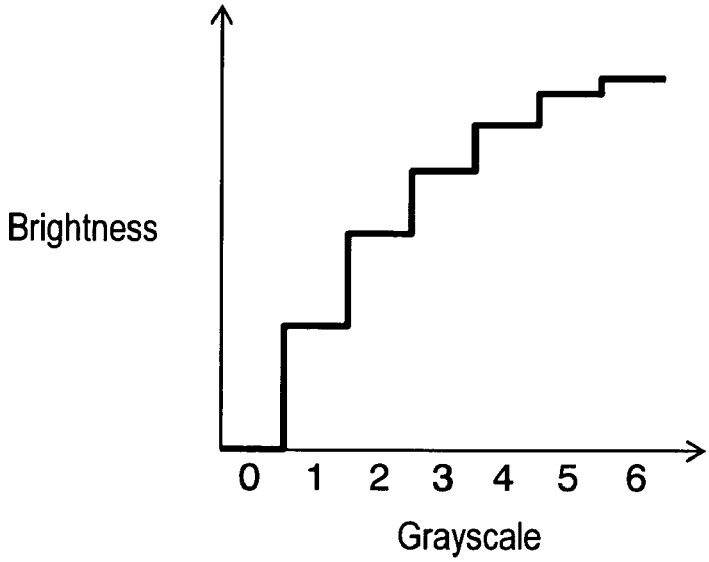
FIG. 6B is a view schematically showing a relation of the grayscale and brightness with respect to the displayable luminances.

However, as is generally known, brightness that a human can sense (hereinafter, referred to simply as brightness) is logarithmic with respect to luminances. FIGS. 6A and 6B are views schematically showing a relation of the grayscale and the displayable luminances and a relation of the grayscale and brightness with respect to displayable luminances, respectively. As is shown in FIG. 6A, the displayable luminances by the panel take values at regular intervals. However, as is shown in FIG. 6B, for brightness proportional to the logarithms of the displayable luminances, the intervals are not regular. The interval in displayable brightness is large at low luminances and a pseudo contour is noticeable. On the contrary, brightness is displayed finely more than necessary at high luminances. It is therefore anticipated that the display quality of an image is not impaired even when luminances used for display, that is, luminances for display, are limited to some extent within a range not to make the intervals in brightness at high luminances so large.

A concrete method of choosing luminances for display among displayable luminances will now be described. As has been described, brightness a human can sense is logarithmic with respect to luminances, and in order to make the intervals in brightness equal, the luminances for display are changed to a geometric progression.

Initially, a ratio of the magnitude of intervals of the luminances for display and the display luminance at that magnitude is set to a value that does not provide a feeling of discomfort visually. In this embodiment, this value is set to 2%. Hence, a ratio of the luminance for display and the closest display luminance, that is, a ratio of luminances for display, is 1.02. Subsequently, a geometric progression is formed in such a manner that the luminance decreases from the highest luminance used for display, for example, "255". It is then possible to successively determine the numerical values in the geometric progression as follows in descending order with the use of the ratio of luminances for display, 1.02:"255", "255/1.02"="250", "255/$(1/02)^2$"="245.1", "255/$(1/02)^3$"="240.3", followed by "235.6", "231.0" and so forth determined in the same manner. By converting the geometric progression thus formed to scales of brightness by taking the logarithms, an arithmetic progression is obtained, with which a human can sense brightness at regular intervals.

Figure 7A:
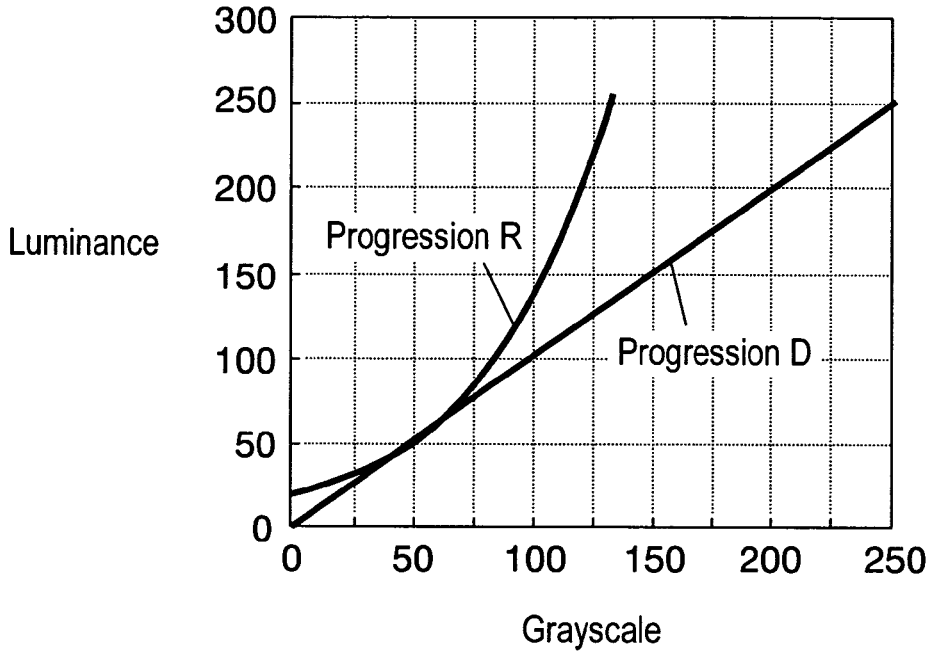
FIG. 7A is a view used to describe a concrete method of choosing luminances for display among the displayable luminances in the image display method according to the embodiment of the invention.
Figure 7B:
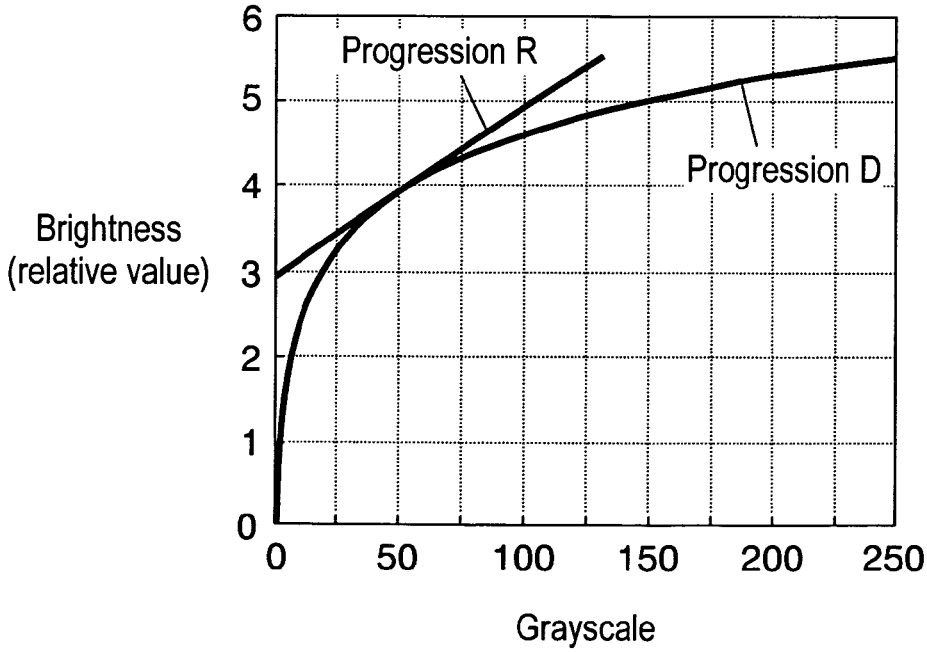
FIG. 7B is another view used to describe the concrete method of choosing luminances for display among the displayable luminances in the image display method according to the embodiment of the invention.

FIGS. 7A and 7B are views used to describe a concrete method of choosing luminances for display among displayable luminances in the image display method according to this embodiment of the invention. Both show graphs drawn in such a manner that the geometric progression (hereinafter, referred to as progression R) formed as described above is tangent to the original arithmetic progression of the displayable luminances, "0", "1", "2" . . . and "255" (hereinafter, referred to as progression D). In FIG. 7A, the abscissa is used for the grayscale and the ordinate is used for luminances. In FIG. 7B, the abscissa is used for the grayscale and the ordinate is used for the logarithms of luminances as indexes of brightness. In this embodiment, as is shown in FIG. 7A, two graphs are tangent to each other at the luminance "50". This indicates that among the displayable luminances at which a ratio of a given displayable luminance and the closest displayable luminance is equal to or lower than the ratio of luminances for display, "50" is the lowest luminance. In this embodiment, "50" is given as a specific luminance, and brightness is displayed finely more than necessary for progression D at the luminance "50" or higher. It is therefore understood that an image display can be performed using progression R instead of progression D. Hence, at the luminance "50" or higher, the luminances of the progression R rounded off to the nearest whole numbers are used as the luminances for display.

On the other hand, at the luminances lower than the luminance "50", the corresponding region is a region where the resolution in brightness is insufficient even when progression D, that is, all the displayable luminances, is used. Hence, at the luminances lower than the luminance "50", it is preferable to perform an image display using an interpolation method, such as the error diffusion and dither diffusion, at the same time.

FIGS. 8A and 8B are views indicating the display luminances formed in the manner described above, and for those equal to or lower than the luminance "50", the luminances are formed using progression D, and for those equal to or higher than the luminance "50", the luminances are formed using progression R. In this instance, for a luminance having a difference between the luminance for display and the closest display luminance, that is, one half of the magnitude of the interval of the luminances for display, greater than the luminance weight of first SF, it is thought that emission or non-emission of light in first SF does not provide significant influences to brightness. Likewise, for the luminances with which one half of the magnitude of the intervals of the luminances for display is greater than the luminance weight of second SF, it can be thought that emission or non-emission of light in second SF does not provide significant influences to brightness. Hence, the influences to an image display is small even when the discharge cell is allowed to emit light in first SF unfailingly for the luminances with which one half of the magnitude of the interval of the luminances for display is greater than the luminance weight of first SF, and the discharge cell is allowed to emit light also in second SF unfailingly for the luminances with which one half of the magnitude of the interval of the luminances for display is greater than the luminance weight of second SF. FIG. 8 indicates the magnitudes of the intervals of luminances as well.

By taking into account an error caused by rounding of f progression R to the nearest whole number, in this embodiment, when the discharge cell is allowed to emit light at the luminances for display at or higher than the first threshold value, "100", at which the magnitude of the interval of the luminances for display becomes greater than 2×(the luminance weight of first SF)+1, the discharge cell is controlled to emit light constantly in first SF unfailingly. When the discharge cell is allowed to emit light at the luminance for display at or higher than the second threshold value, "200", at which the magnitude of the interval of the luminances for display becomes greater than 2×(the luminance weight of second SF)+1, the discharge cell is controlled to emit light constantly in both first SF and second SF unfailingly.

As has been described, according to the image display method of this embodiment, as are shown in FIGS. 5A and 5B, the luminances for display are the luminances expressed by an arithmetic progression: "0", "1", "2", "33" . . . "49", and "50" at or lower than the luminance "50", and at the higher luminances, they are the luminances expressed by a geometric progression: "51", "52" . . . "101", "103", "105" . . . "245", "250" and "255". Further, the discharge cells that display luminances at or higher than the first threshold value, "100", are controlled to emit light in first SF unfailingly, and the discharge cells that display luminances at or higher than the second threshold, "200", are controlled to emit light in both first SF and second SF unfailingly.

By executing the control as described above, in regions where luminances at or higher than the respective threshold values are displayed, the writing pulse is kept applied to the data electrodes during the writing period in the corresponding sub-field, and the number of charge and discharge operations can be reduced correspondingly. It is thus possible to reduce power consumption of data electrode driving circuit 12. When the inventors actually measured power consumption of data electrode driving circuit 12 using the coding, the effect of a reduction by up to 25% was confirmed.

In this embodiment, a ratio of the magnitude of the intervals of the luminances for display and the display luminance at the magnitude was set to 2%. However, this value varies markedly with the signal processing, and it can be set larger in practice, for example, by performing interpolation processing, such as the error diffusion. In addition, it was assumed in this embodiment that the ratio of luminances for display is constant regardless of the luminances. However, the ratio of luminances for display is not necessarily constant depending on the interpolation methods. FIGS. 9A and 9B show one example of luminances for display and the coding thereof used in the image display method according to another embodiment of the invention. This is an example in a case where the intervals of the luminances for display at low luminances are set relatively large by performing relatively strong interpolation processing at low luminances. In this example, the discharge cells that display luminances at or higher than a first threshold value, "24", are controlled to emit light in first SF unfailingly, and the discharge cells that display luminances at or higher than a second threshold value, "42", are controlled to emit light in both first SF and second SF.

In this embodiment, the discharge cells are controlled to emit light in first SF for the luminances for display at higher than the first threshold value, and the discharge cells are controlled to emit light in second SF for the luminances for display at or higher than the second threshold value. However, the discharge cells may be controlled not to emit light in first SF for the luminances for display at or higher than the first threshold value, and the discharge cells may be controlled not to emit light in second SF for the luminances for display at or higher than the second threshold value. In this case, too, the number of charge and discharge operations to the corresponding data electrodes can be reduced without impairing the image display quality. It is thus possible to reduce power consumption of data electrode driving circuit 12 correspondingly. Further, the control may be performed in the same manner as above by setting a third threshold value . . . and an Nth threshold value.

The embodiments described the panel as an example of the image display device having a large number of pixels arrayed in a planar form. The invention, however, can be applied to any image display device that displays an image using the sub-field method, such as the DMD.

INDUSTRIAL APPLICABILITY

According to the image display method of the invention, it is possible to reduce power consumption of the data electrode driving circuit without impairing the image display quality. The image display method is therefore useful as the image display method for a panel or the like.

The invention claimed is:

1. An image display method for displaying an image comprising:

forming one field period by a plurality of sub-fields, whose luminance weights to be displayed are determined, for an image display device having a large number of pixels arrayed in a planar form;

choosing a plurality of luminances among displayable luminances as luminances for display by combining the luminance weights of the sub-fields; and controlling the respective pixels so as to emit light or not to emit light in each sub-field, corresponding to the luminances for display to be displayed, wherein at least one threshold value to be compared with the luminances for display is set, the at least one threshold value including a first threshold value, and when a pixel is allowed to emit light at a luminance for display at or higher than the first threshold value, the pixel is either in a non-emission status or controlled constantly to emit light in a sub-field having a smallest luminance weight.

2. The image display method of claim 1, wherein in a case where the luminance weight of the sub-field having the smallest luminance weight is defined as $W_1$, the first threshold value is equal to a lowest luminance for display among the luminances for display having $2W_1+1$ or greater as a difference between the luminance for display and a closest luminance for display.

3. The image display method of claim 1, wherein;

the at least one threshold value including a plurality of threshold values from the first threshold value to Nth threshold values (N is an integer equal to or larger than 2), when the pixel is allowed to emit light at a luminance for display at or higher than the Nth threshold value, which is larger than an N−1th threshold value, the pixel is either in a non-emission status or controlled constantly to emit light in a sub-field having an Nth smallest luminance weight.

4. The image display method of claim 3, wherein in a case where the luminance weight of the sub-field having the Nth smallest luminance weight is defined as $W_N$, the Nth threshold value is equal to a lowest luminance for display among the luminances for display having $2W_N+1$ or greater as a difference between the luminance for display and a closest luminance for display.

5. The image display method of claim 1, wherein the luminances for display are set in a manner of a geometric progression at luminances higher than a specific luminance; and the luminances for display are set in a manner of an arithmetic progression at luminances lower than the specific luminance.

6. The image display method of claim 5, wherein, when a ratio of the luminance for display and a closest luminance for display which is closest to the luminance for display is set as a ratio of luminances for display, the specific luminance is a lowest displayable luminance among the displayable luminances having a ratio of the displayable luminance and a closest displayable luminance which is closest to the displayable luminance, equal to or lower than the ratio of luminances for display.

7. The image display method of claim 1, wherein:

the at least one threshold value including a plurality of threshold values from the first threshold value to Nth threshold values (N is an integer equal to or larger than 2), and the first threshold value is smallest among the plurality of threshold values.

* * * * *